US005390750A

United States Patent [19]

Deken et al.

[11] Patent Number: 5,390,750

[45] Date of Patent: Feb. 21, 1995

[54] DOWNHOLE COMPACTION AND STABILIZATION BACK REAMER AND DRILL BIT

[75] Inventors: Arthur D. Deken; Cody L. Sewell, both of Perry, Okla.

[73] Assignee: The Charles Machine Works, Inc., Perry, Okla.

[21] Appl. No.: 79,197

[22] Filed: Jun. 21, 1993

Related U.S. Application Data

[63] Continuation of Ser. No. 764,180, Sep. 23, 1991, Pat. No. 5,220,964.

[51] Int. Cl.[6] ..... E21B 7/08; E21B 7/28

[52] U.S. Cl. ..... 175/406; 175/61

[58] Field of Search ..... 175/406, 323, 334, 335, 175/407

[56] References Cited

U.S. PATENT DOCUMENTS

| | | | |
|---|---|---|---|
| 1,418,255 | 5/1922 | Greenlee | 175/406 X |
| 1,848,128 | 3/1932 | Hinderliter | 175/406 X |
| 2,088,770 | 8/1937 | Skinner | 175/406 |
| 2,210,824 | 8/1940 | Walker, Sr. | 175/406 |
| 2,328,735 | 9/1943 | Miller . | |
| 2,472,749 | 6/1949 | Lake | 175/406 |
| 2,599,041 | 6/1952 | Bannister . | |
| 2,727,730 | 12/1955 | Crake | 175/406 X |
| 2,809,015 | 10/1957 | Phipps . | |
| 2,911,195 | 11/1959 | Backer . | |
| 2,973,821 | 3/1961 | Stihl . | |
| 3,338,069 | 8/1967 | Ortloff | 175/406 X |
| 3,945,447 | 3/1976 | Peterson . | |
| 5,174,391 | 12/1992 | Zijsling | 175/323 X |
| 5,220,964 | 6/1993 | Deken et al. | 175/406 |

*Primary Examiner*—Stephen J. Novosad
*Attorney, Agent, or Firm*—Richards, Medlock & Andrews

[57] ABSTRACT

Improved back reamers (20, 60, 80, 100) are disclosed for use in back reaming a pilot bore in a trenchless boring operation. In three of the heads (20, 60, 100), truncated cylinders are mounted on a body (22) of the head with the truncated cylinders each defining a convex truncated surface facing the walls of the bore. Rotation of the head while moving the head in the direction to be reamed, the convex truncated surface will compact the soil into a wall of the bore of desired final diameter and stabilize the wall. A back reamer (80) is provided with a plurality of directional cams (84) which permit the head to be oscillated in either direction about the drill string axis. The heads can be reversed to act as drill bits as well.

2 Claims, 4 Drawing Sheets

DOWNHOLE COMPACTION AND STABILIZATION BACK REAMER AND DRILL BIT

This is a continuation of application Ser. No. 07/764,180, filed on Sep. 23, 1991, now U.S. Pat. No. 5,220,964.

TECHNICAL FIELD OF THE INVENTION

This invention relates to the process of horizontal boring with a drill rig that creates a pilot bore, and to the expansion of the pilot bore with a back reamer.

BACKGROUND OF THE INVENTION

Trenchless boring technology has been developed for drilling a horizontal bore underground for passage of a utility line or the like, without the need to excavate the entire length of the line. In the usual process, a drill rig will first drill a pilot bore. It is essential to have a steerable boring tool which permits control of the direction of boring to insure that the pilot bore will end at the desired location.

After the pilot bore has been completed, a back reamer is run through the pilot bore, typically in the direction opposite the direction that the pilot bore was formed. The back reamer expands the bore to the desired final diameter and compacts and stabilizes the earth forming the walls of the bore to resist collapse of the bore.

A back reamer with a flighting, or helical screw style of thread, is typical of prior back reamer design. The flighted back reamer is rotated while it is pulled through the pilot bore to screw into the compactable soil. Straight cones have also been used, which are pulled without rotation through the pilot bore, although these cones require significant pullback forces.

Fluid has also been injected in the pilot bore to enlarge the bore. This fluid injection creates a slurry that must be partially removed from the borehole before the utility line is placed through the bore.

A need yet exists for an improved process and apparatus for drilling a pilot bore and back reaming the pilot bore with the minimum expenditure of energy while insuring a stable and well compacted bore wall.

SUMMARY OF THE INVENTION

In accordance with one aspect of the present invention, a back reamer is provided for back reaming and compacting a pilot bore. The reamer is mounted on a drill string for rotation with the drill string about a first axis and for linear movement with the drill string along the axis. The reamer includes a body having an axis aligned with the first axis Of the drill string and at least one truncated cylinder mounted on the body with the cylinder axis parallel to and offset from the axis of the body. The cylinder has a truncated convex surface centered on the cylindrical axis and exposed to the walls of the pilot bore. Simultaneous rotation and linear motion of the drill string causes the truncated convex surface to contact the walls of the pilot bore to enlarge the pilot bore and compact the walls of the bore.

In accordance with another aspect of the present invention, a truncated second cylinder is mounted on the opposite side of the body axis from the first cylinder. In accordance with another aspect of the present invention, a truncated cylinder is mounted to the body and is positioned along a helical line formed about the body axis extending from the first cylinder.

In accordance with yet another aspect of the present invention, a back reamer is provided with a body having an axis aligned with the first axis of the drill string and at least one bidirectional cam formed on the body. The drill string can be reciprocally rotated in both directions about the first axis as the drill string and back reamer are moved through the pilot bore to enlarge the bore and compact the walls of the bore.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION

Figure 1:
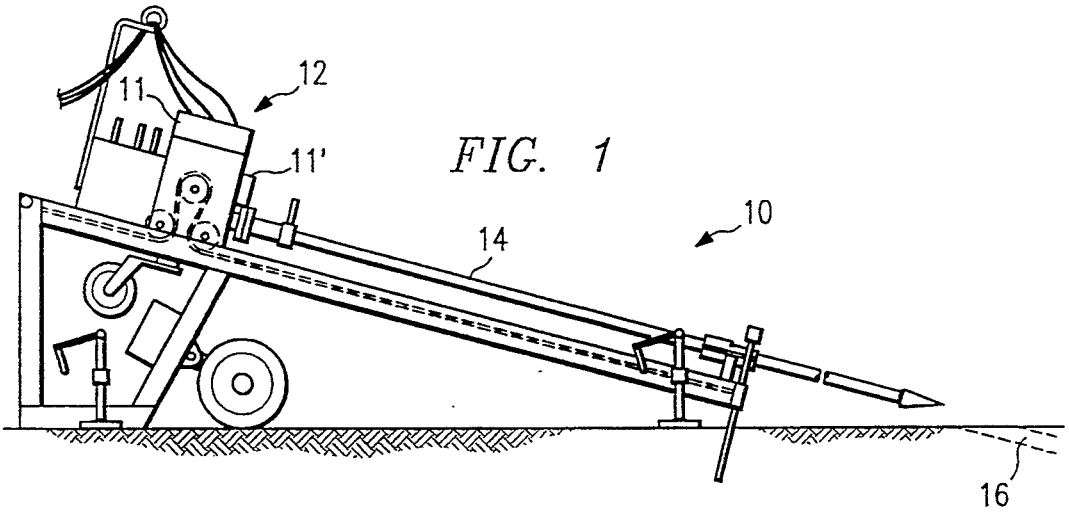
FIG. 1 is an illustrative view of trenchless boring apparatus.

With reference now to the accompanying drawings, and in particular to FIG. 1, the present invention relates to the technology of drilling a trenchless bore underground for utility lines and other services. This technology eliminates the necessity of excavating from the surface to the depth of the bore along the entire length of the bore, and also allows the bore to be formed under preexisting structures without damaging or interfering with those structures.

FIG. 1 illustrates a typical trenchless drilling apparatus 10. The apparatus includes a drilling platform 12 which can be mounted on the surface at one end of the bore 16, or within a trench dug to accommodate the platform. The platform 12 is capable of rotating a drill string 14 in either direction about the linear axis of the drill string and also of pushing or pulling the drill string 14 through the bore 16.

In the initial formation of the bore, a directional boring head is used to create a pilot bore. A steerable boring head which permits the direction of drill string travel to change is a necessity in trenchless drilling to insure that the bore will travel underground to end at the proper location.

Figure 5:
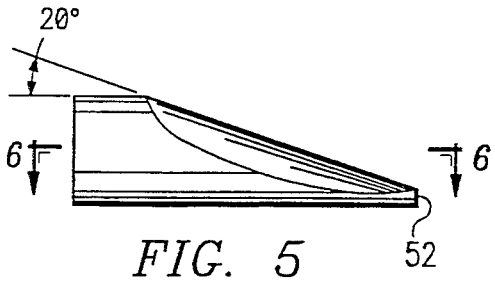
FIG. 5 is a side view of a cylinder in the reamer illustrating the convex truncated surface.
Figure 7:
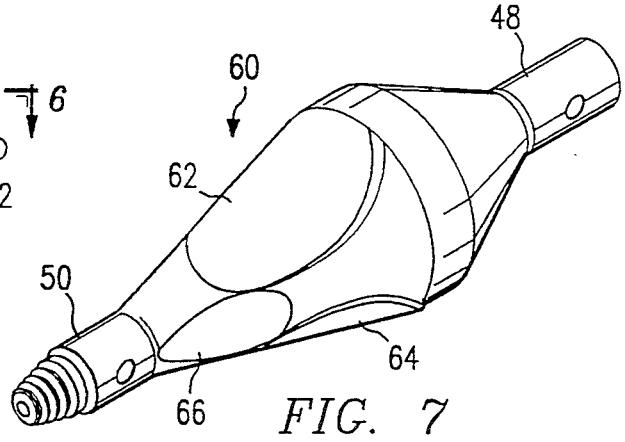
FIG. 7 is a perspective view of a back reamer forming a first modification of the present invention.

One type of directional boring head is a cylinder with a truncated convex surface, much as illustrated in FIG. 5. Such a boring head is manufactured and sold by The Charles Machine Works, Inc. of Perry, Okla. as the model P40 head. A model P80 head from this company is also of this type. The head is mounted at the end of the drill string. If the drill string is rotated rapidly, for example 60–120 rpm, while the drill string is pushed forward in the bore by the drilling platform 12, a linear bore will be drilled. If the operator wishes to change the direction of the bore, the drill string rotation is stopped and the boring head is positioned so that a thrust forward of the drill string will cause the boring head to deflect in the desired direction. Rapid rotation of the drill string can then be recommenced to drill in a linear direction along the new bore line.

The truncated cylindrical boring head has specific advantages in hard, less compactable soils. In accordance with the present invention, the hydraulic motor 11 on apparatus 10 which rotates drill string 14 can be reversed in an oscillating manner. For example, the motor can rotate the drill string three revolutions in one direction, reverse the rotation for three revolutions in the opposite direction and repeat this cycle for the drilling. By oscillating the head only a few degrees in each direction while simultaneously thrusting the head forward, the head will take a new direction and start a new line of bore travel even in soil conditions where the drilling platform may not have sufficient thrust to advance the head without rotation. The slight side to side rotation of the convex surface of the truncated cylinder provides a reduced thrust requirement, allowing the inclined plane to, in an incremental fashion, penetrate the formation and redirect the bore line.

The head will work in compactable soils using either wet or dry boring technology. The head will redirect the drill string easier when a small, controlled amount of fluid is used as a lubricant. The use of water jet technology in some soil conditions reduces the ability of the head to redirect the line of the bore. In such cases, the bore can actually be washed out or enlarged causing a slower reaction to redirecting attempts.

Another improvement of the pilot boring head is the difference between the diameter of the head and the diameter of a tracking electronics housing positioned behind the head. If there is a differential between the diameter of the boring head and the electronics housing, thus forming an annulus in the borehole, the ability to redirect the line of the bore is enhanced. If the annulus is not present, the side of the electronics housing or the forward end of the drill string is more likely to be held in place by the wall of the bore drilled and the deflection of the drill string is resisted. The P40 and P80 heads mentioned previously are the same size as the transmitter housing and thus could not achieve this advantage (even though the P40 and P80 heads and transmitter head have a larger diameter than the string of rods in the drill string to which they attach).

After drilling of the pilot bore by the boring head, a back reamer is necessary to enlarge the bore to the final dimensions and to compact and stabilize the dirt into the walls of the bore. Typical designs that have been used as back reamers are a flighted screw or simply a straight cone pulled straight through the pilot bore.

With reference now to FIGS. 2–6, an improved back reamer 20 is illustrated which forms a first embodiment of the present invention. The back reamer 20 includes a body 22 with a central axis 24. The body has a female threaded end 26 and a male threaded end 28. In a typical back reaming operation, the male threaded end 28 will be threaded into the end of the drill string 14. The female threaded end 26 can be threaded to a swivel at the end of the cable or line that the bore is intended to carry to pull the cable through the bore as the bore is back reamed. A passage 30 is formed through the body concentric with the central axis 24. A cutting fluid can be supplied through passage 30 from the drill string and discharged through controlled fluid outlets 32 and 34 to assist the back reaming operation.

Figure 4:
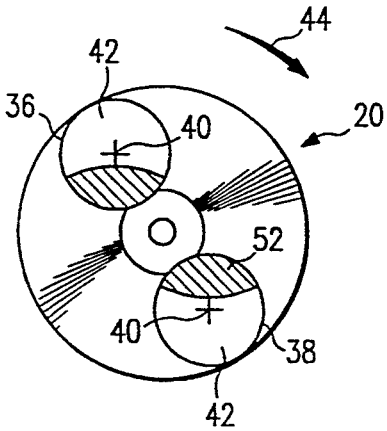
FIG. 4 is a cross-sectional view of the reamer taken along lines 4—4 in FIG. 3.
Figure 3:
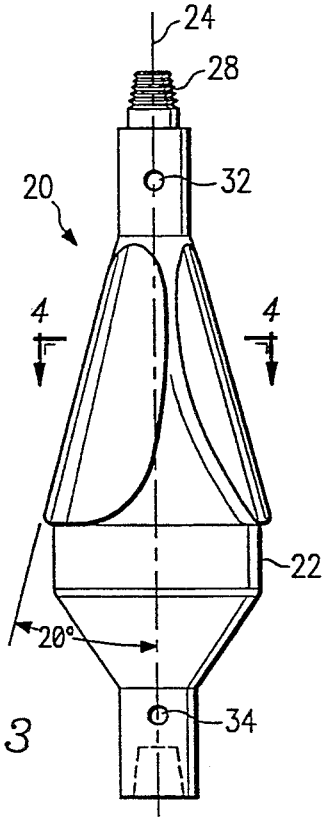
FIG. 3 is a side view of the back reamer of FIG. 2.

Mounted on the body 22 can be a plurality of surfaces as indicated by a first truncated cylinder 36 and a second truncated cylinder 38. The cylinder axis 40 of each of the cylinders is parallel to the central axis 24 but offset from that axis as best seen in FIG. 4. Each cylinder has a convex truncated surface 42 which faces outwardly from the body. In the preferred embodiment, the truncated surface is formed at a 20° angle from the central axis 24 and axis 40 of the cylinder. However, this angle can vary between at least 15° to 25°. It is preferable to decrease the angle for larger bore diameters. This surface can be formed on a lathe with the cylinder centerline offset from the spindle center of rotation, by use of a taper machining fixture. Alternate methods of creating the effect of this surface are described hereafter.

Figure 2:
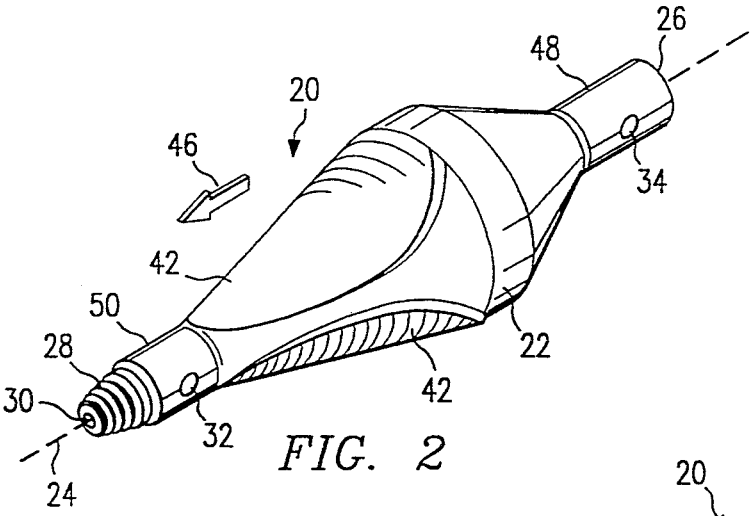
FIG. 2 is a perspective view of a back reamer forming a first embodiment of the present invention.

When the drill string and back reamer 20 are rotated in the direction of arrow 44 in FIG. 4, while the drill string and back reamer 20 are pulled in the direction of arrow 46, as seen in FIG. 2, the head 20 will effectively ream the pilot bore to a final bore diameter with a well compacted and stable wall. The surfaces 42 provide a cam-like compacting action as the back reamer is rotated, with the convex surfaces contacting the walls of the pilot bore and compacting the soil at an angle perpendicular to the convex surface and at a compound angle to the axis of the pilot bore that results in a cam-like compacting action against the formation. This compacting action reduces the amount of torque and pull-back force required of the drilling platform over that required by conventional compaction reamers. The truncated cylinders 36 and 38 are preferably located 180° apart about the body, as seen in FIG. 4, so that the axis 24 and axis 40 can be connected by a straight line as seen in that figure.

The back reamer 20 can be formed with the cylinders 36 and 38 mounted on the body 22, or the body and cylinders can be cast together to form the desired outer shape.

Figure 5A:
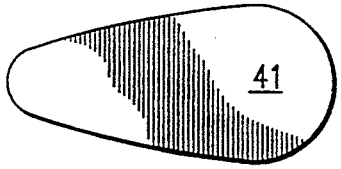
FIGS. 5A–E illustrate a truncated surface for the reamer made from a sheet metal blank.
Figure 5C:
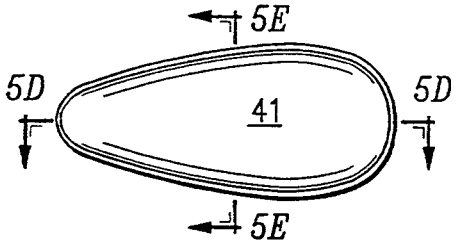
Figure 5B:
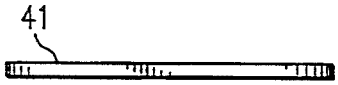
Figure 5D:
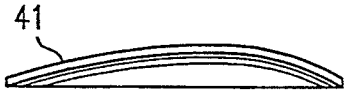
Figure 5E:
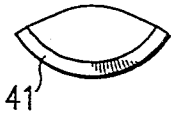
Figure 6A:
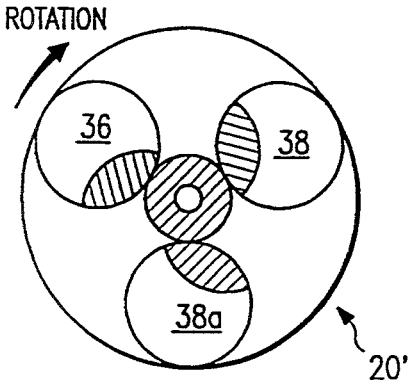
FIGS. 6A and 6B illustrate reamers with three truncated surfaces.
Figure 6:
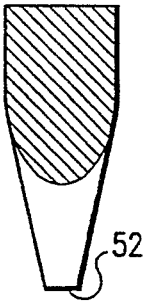
FIG. 6 is a section view of the cylinder taken along line 6—6 in FIG. 5.
Figure 6B:
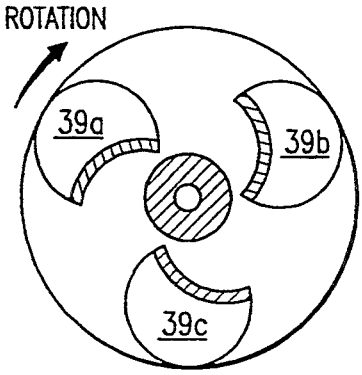
Figure 8:
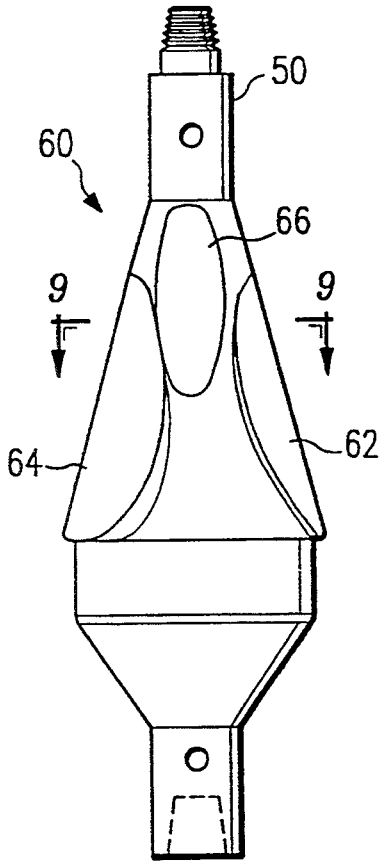
FIG. 8 is a side view of the back reamer of FIG. 7.
Figure 9:
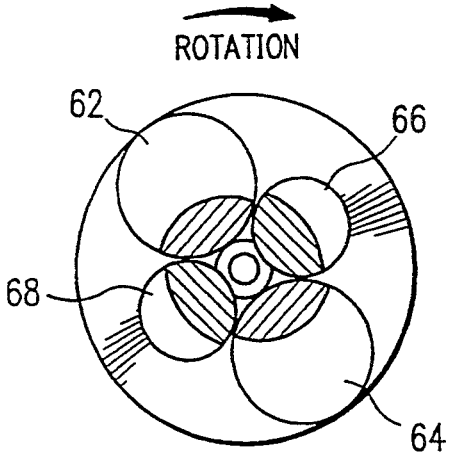
FIG. 9 is a cross sectional view taken along line 9—9 in FIG. 8.
Figure 10:
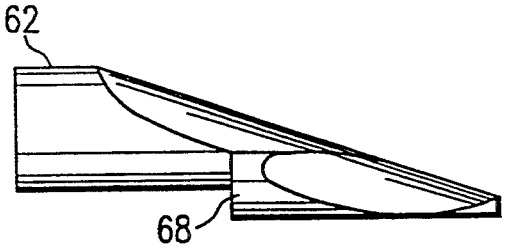
FIG. 10 is a side view of the cylinders used in the back reamer of FIG. 7.

In addition, surfaces of cylinders 36 and 38 can be formed either from a sheet metal blank or machined from a solid round bar. As seen in FIGS. 5A–E, the sheet metal blank 41 is cut as shown in FIGS. 5A and 5B. As one example, the sheet metal blank 41 can be 0.25 inches thick. The blank 41 is then placed into a forming die and pressed to form the truncated convex surface as seen in FIGS. 5C–E. Alternatively, as seen in FIGS. 6A and 6B, more cylinders can be mounted on body 22 as required for different soil conditions. The reamer 20' of FIG. 6A shows three cylinders 36, 38 and 38A formed of solid round bars with machined surfaces. FIG. 6B illustrates three formed members 39A, 39B and 39C each defining a truncated convex surface formed from sheet metal blanks 41.

In one back reamer 20 constructed in accordance with the teachings of the present invention, the body 22 had a maximum diameter of six inches. The sections 48 and 50, ending with threaded ends 26 and 28, are one and three-quarters inches in diameter. The cylinders were two and one-half inches in diameter with the truncation being made at a 20° angle relative the axes of 40 and starting at a one inch offset from the center line so that an arcuate portion of the end 52 of the cylinder remains.

With reference now to FIGS. 7–10, a back reamer 60 forming a first modification of the present invention is illustrated. Many of the elements of head 60 are identical to those previously described with regard to back reamer 20, and are identified by the same reference numeral. In back reamer 60, a plurality of truncated cylinders are distributed in a helical line along the head to provide enhanced compaction. More specifically, truncated cylinders 62 and 64 are mounted on the body 22 on opposite sides thereof proximate the major diameter of the head 60. Truncated cylinders 66 and 68 are mounted to the body 22 between the cylinder 62 and 64 and the section 50. The cylinders 66 and 68 are positioned relative to cylinder 62 and 64 along helical lines centered about the central axis 24 and directed in the rotational direction of the back reamer.

Figure 11:
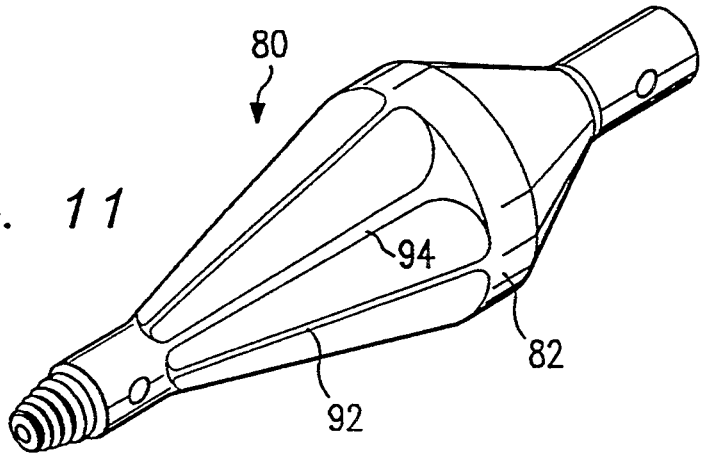
FIG. 11 is a perspective view of a back reamer forming a second modification of the present invention.
Figure 12:
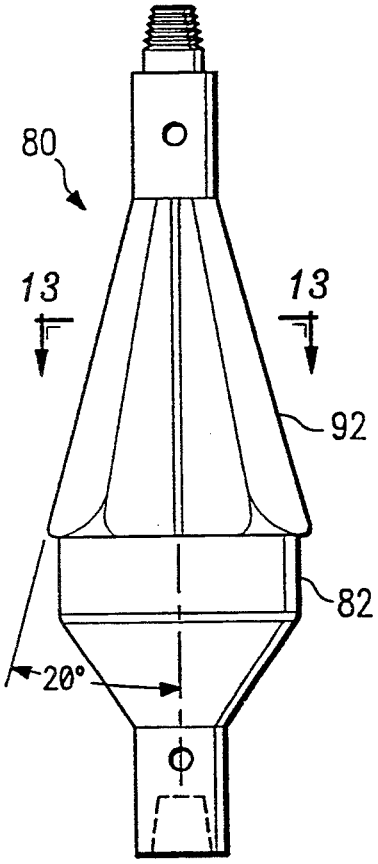
FIG. 12 is a side view of the back reamer of FIG. 11.
Figure 13:
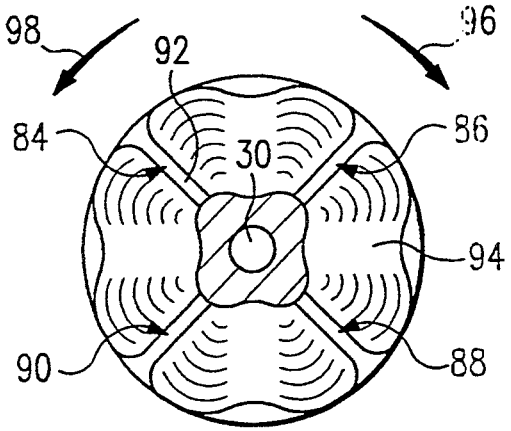
FIG. 13 is a cross-sectional view taken along line 13—13 in FIG. 12.

With reference now to FIGS. 11–13, a back reamer 80 forming a second modification of the present invention is illustrated. Again, many elements of head 80 are identical to those of head 20 and are identified by the same reference numeral. However, back reamer 80 is formed of a body 82 having four symmetrically oriented bidirectional cams 84, 86, 88 and 90. As seen in FIG. 12, the high edge 92 of each cam will be oriented at a 20° angle to the central axis 24 of the body 82. From the high edge 92, each bidirectional cam slopes in either direction in a convex manner from the edge 92 to low point lines 94. With back reamer 80, it is preferred to rotate the drill string in the direction of arrow 96 for a number of revolutions, for example three, then reverse the rotation in the opposite direction, shown by arrow 98, in a predetermined oscillation. This will normally require drill string connectors of a bidirectional type such as shown and described in U.S. Pat. No. 4,422,794 to Deken issued Dec. 27, 1983. If desired, head 20, 60 or 80 can be provided with carbide or other hard surface cutting materials installed thereon to facilitate the cutting of harder, less compactable soils or of rock-like materials.

The passageway 30 can be used for the injection of small controlled amounts of fluid either ahead of, behind, or from both ends of the head 20, 60 or 80. This fluid, in a form of either a drilling fluid or plain water, is used to lubricate the surfaces of the back reamer and reduce the rotational torque and axial pull required of the drilling platform.

The metered fluid can be transmitted to the back reamer by a pump, either from the up hole end through hollow drill string rods, or from the downhole end of the borehole through an auxiliary hose installed in or beside the service being pulled in through a swivel pull back device at the rear of the back reamer.

A little as one cup (eight ounces) of fluid introduced into the borehole at the front of the reamer through the orifice 32 has been found to reduce the reamer rotational torque and pullback force requirements 25% or more in tough, hard packed soils or sands for distances of five feet or more. Other orifice sizes can be employed for various situations. A controlled fluid flow improves the rate of back reaming and allows the use of a smaller drilling platform than would usually be the case for a dry bore compaction process.

Figure 15:
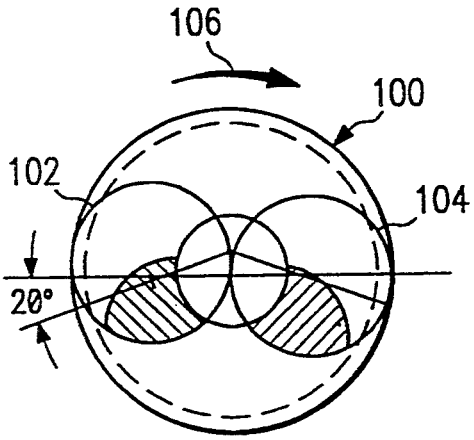
FIG. 15 is an end view of the back reamer of FIG. 14.
Figure 14:
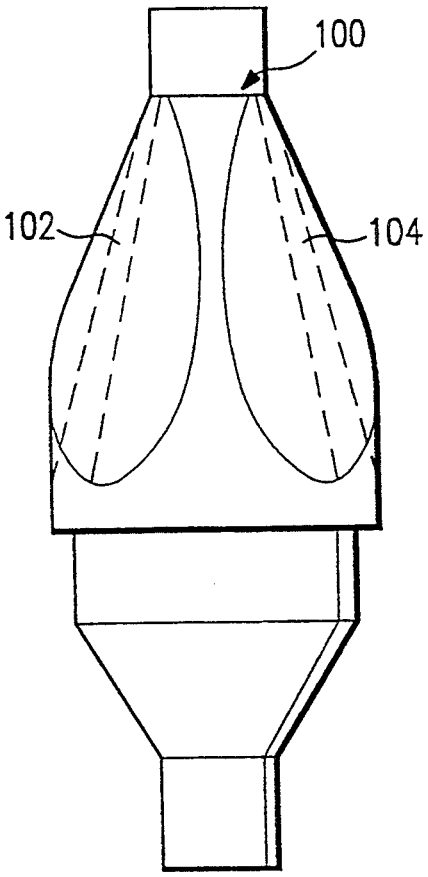
FIG. 14 is a side view of a back reamer forming a second embodiment of the present invention.

With reference to FIGS. 14 and 15, a back reamer 100 is illustrated which mounts a first truncated cylinder 102 and a second truncated cylinder 104. The cylinders are mounted on the head 100 in the same manner cylinders 36 and 38 are mounted on head 20 with the exception that cylinder 102 is designed to be effective in back reaming when the head is rotated in the direction of arrow 106 while cylinder 104 is effective when the head 100 is rotated in the opposite direction. Head 100 is particularly suited for a reversing drill string where the direction of motion can be reversed, which permits oscillation of the drill string and reamer. The string can be rotated, for example, three revolutions in one direction, and the rotation reversed for three revolutions in the reverse direction, with this cycle repeated until the job is complete. If a hydraulic motor is used to rotate the drill string, a Hall effect sensor 11' can be used to count the revolutions in each direction and reverse the direction of rotation after a preset number of revolutions have been counted. The actual reversal can be achieved with solenoid activated hydraulic reversing valves controlled by the Hall effect sensor.

As can be appreciated, the present invention provides significant advantages over current techniques. These advantages include the elimination of a large drilling fluid tank and pumping system. The clean up and disposal of excess drilling fluids and cuttings and the associated equipment is eliminated. A solid rod drill string can be used for improved strength and lower cost. The invention will operate in most compactable soils. Production rates will improve because of the elimination of the time required to pressure a drill string with boring fluid. Less torque and thrust is required when compared to the push rod style of compaction boring systems. Directional control is improved in some soil types when using a dry pilot bore process due to the elimination of the washing out of the formation by the volume and pressure of cutting fluid. The pull back and back reamer operation is improved. The borehole can collapse in some soils when a large amount of fluid is applied to the borehole. Increased pullback force is required to overcome the added resistance due to the collapsed hole.

Although several embodiments of the invention have been illustrated in the accompanying drawings and described in the foregoing detailed description, it will be understood that the invention is not limited to the embodiments disclosed, but is capable of numerous rearrangements, modifications, and substitutions of parts and elements without departing from the scope and spirit of the invention.

We claim:

1. A back reamer for backreaming and compacting a pilot bore, the head mounted on a drill string for rotation with the drill string about a first axis of the drill string and for linear motion with the drill string along the axis, the back reamer comprising:

a head defining at least one bidirectional cam to contact the walls of the pilot bore to enlarge the pilot bore and compact the walls of the bore as the head is rotated in either direction about the first axis and moved along the axis, the body having a fluid passage formed therethrough, at least one controlled fluid outlet formed in the body between the passage and exterior of the body for flow of a fluid in a controlled manner from the passage exterior the body to enhance backreaming operation.

2. A drill head for drilling a pilot bore in a formation, the head mounted on a drill string for rotation with the drill string about a first axis of the drill string and for linear motion with the drill string along the axis, the drill head comprising:

a head defining at least one bidirectional cam to contact the formation to drill the pilot bore as the head is rotated in either direction about the first axis and moved along the axis, the body having a fluid passage formed therethrough, at least one controlled fluid outlet formed in the body between the passage and exterior of the body for flow of a fluid in a controlled manner from the passage exterior the body to enhance drilling operation.

* * * * *